US008348018B2

(12) United States Patent
Kostka

(10) Patent No.: US 8,348,018 B2
(45) Date of Patent: Jan. 8, 2013

(54) DISPLAY DEVICE FOR AN ELEVATOR SHAFT IN WHICH SEVERAL ELEVATOR CABINS TRAVEL

(75) Inventor: Miroslav Kostka, Ballwil (CH)

(73) Assignee: Inventio AG, Hergiswil (CH)

( * ) Notice: Subject to any disclaimer, the term of this patent is extended or adjusted under 35 U.S.C. 154(b) by 487 days.

(21) Appl. No.: 12/450,220

(22) PCT Filed: Mar. 14, 2008

(86) PCT No.: PCT/EP2008/053122

§ 371 (c)(1),
(2), (4) Date: Mar. 11, 2010

(87) PCT Pub. No.: WO2008/110631

PCT Pub. Date: Sep. 18, 2008

(65) Prior Publication Data

US 2010/0175953 A1 Jul. 15, 2010

(30) Foreign Application Priority Data

Mar. 15, 2007 (EP) ..... 07104216

(51) Int. Cl.
*B66B 9/00* (2006.01)

(52) U.S. Cl. ..... 187/249; 187/396

(58) Field of Classification Search ..... 187/247, 187/248, 249, 380–389, 391–394, 396, 901
See application file for complete search history.

(56) References Cited

U.S. PATENT DOCUMENTS

| | | | | |
|---|---|---|---|---|
| 3,658,155 | A * | 4/1972 | Salter | 198/798 |
| 3,740,709 | A * | 6/1973 | Savino | 187/391 |
| 4,064,971 | A | 12/1977 | Iwasaka et al. | |
| 5,886,696 | A * | 3/1999 | Kakko et al. | 715/787 |
| 6,394,231 | B1 * | 5/2002 | Schuster et al. | 187/382 |
| 6,868,945 | B2 * | 3/2005 | Schuster et al. | 187/380 |
| 7,032,716 | B2 * | 4/2006 | Meyle et al. | 187/382 |
| 7,036,635 | B2 * | 5/2006 | Rintala et al. | 187/396 |
| 7,404,469 | B2 * | 7/2008 | Takeuchi | 187/391 |
| 7,487,860 | B2 * | 2/2009 | Hikita et al. | 187/249 |
| 7,917,341 | B2 * | 3/2011 | Sansevero et al. | 703/1 |
| 7,987,947 | B2 * | 8/2011 | Christy et al. | 187/249 |
| 8,047,333 | B2 * | 11/2011 | Finschi | 187/382 |
| 8,100,230 | B2 * | 1/2012 | Smith et al. | 187/249 |

FOREIGN PATENT DOCUMENTS

| | | |
|---|---|---|
| EP | 10466005 | 10/2000 |
| GB | 2203568 | 10/1988 |
| JP | 000062116484AA | 5/1987 |
| JP | 000063202577AA | 8/1988 |
| JP | 06127858 A * | 5/1994 |
| JP | 200272850 | 3/2000 |
| JP | 2005047648 | 2/2005 |
| WO | WO 97/37922 | 10/1997 |

* cited by examiner

*Primary Examiner* — Anthony Salata
(74) *Attorney, Agent, or Firm* — Wolff & Samson, PC

(57) ABSTRACT

A display device for a lift system with at least one lift shaft, in which several lift cabins travel. The device includes an allocation manager that allocates an identifier to a lift cabin carrying out a transport job and a display at a boarding location that outputs an identifier of a lift cabin. The display can simultaneously display the identifier for several lift cabins.

14 Claims, 2 Drawing Sheets

6.10
6.9
6.8
6.7
6.6
6.5
6.4
6.3
6.2
4.10
3.10
4.9
3.9
4.8
3.8
4.7
3.7
4.6
3.6
4.5
3.5
4.4
3.4
4.3
3.3
4.2
3.2
2.1
2.2
2.3
2.4
1.2
1.1
A1
A2
A3
5.102
5.101
5.100
5.72
5.71
5.70
5.62
5.61
5.60

2.1
2.2
2.3
2.4
6.10
6.9
6.8
6.7
6.6
6.5
6.4
6.3
6.2
4.10
4.9
4.8
4.7
4.6
4.5
4.4
4.3
4.2
3.10
3.9
3.8
3.7
3.6
3.5
3.4
3.3
3.2
1.2
1.1

A1
A2
A3
5.102
5.101
5.100

5.72
5.71
5.70

5.62
5.61
5.60

DISPLAY DEVICE FOR AN ELEVATOR SHAFT IN WHICH SEVERAL ELEVATOR CABINS TRAVEL

CROSS REFERENCE TO PRIOR APPLICATION

This is a U.S. National Phase Application under 35 U.S.C. §371 of International Patent Application No. PCT/EP2008/053122, filed Mar. 14, 2008, and claims benefit of EP 07104216.2, filed on Mar. 15, 2007. which is incorporated by reference herein. The International Application was published in German on Sep. 18, 2008 as WO/2008/110631 under PCT Article 21(2).

FIELD OF THE INVENTION

The present invention relates to a display apparatus for an elevator system, and to a method for communication with an elevator system such as this.

BACKGROUND OF THE INVENTION

In order to increase the transport capacity, it is known, for example from EP 1 046 605 B1, for a plurality of elevator cabins to be provided in an elevator shaft of a so-called multimobile elevator. Furthermore, a plurality of such elevator shafts can advantageously be provided. When a user now makes a destination call, then an elevator control system assigns an appropriate transport job to one of the available elevator cabins, and informs the user which elevator cabin he is intending to use. For this purpose, the control system signals to the user a specific designation which has been assigned to the elevator cabin which will carry out his transport job, and indicates this designation at an entry location, when the appropriate elevator cabin is available there.

In the exemplary embodiment in EP 1 046 605 B1, the elevator control system allocates, for example, the designation "B3" to one user. If the display which is associated with the elevator shaft "B" now outputs the designation "B1", then the user will be aware that the elevator cabin designated in this way is not intended for him. Only when the display outputs the designation "B3" does the user know that this elevator cabin will now carry out his transport job, and enters. This allows the flow of people to be split up deliberately, thus optimizing the elevator capacity. By way of example, in the stated exemplary embodiment, the "B1" cabin can move to the top floor without interruption, while the "B3" cabin services only the lower floors.

In the method disclosed in EP 1 046 605 B1, the user is not provided with any view of what is happening in the elevator system. In particular, he does not know at an early stage when "his" elevator cabin will be available at the entry location, since all that is output is the designation of the elevator cabin which will in each case be the next to arrive or is currently stopped on that floor. During the waiting time, the user is forced to continuously observe the display at the entry location while waiting for the elevator cabin which has been assigned to his transport job. There is therefore a considerable risk that the user will miss the elevator cabin assigned to his transport job, or will erroneously enter the incorrect elevator cabin.

The object of the present invention is therefore to provide a better display apparatus and a better communication method.

SUMMARY OF THE INVENTION

This object is achieved by a display apparatus having the features described herein and recited by the claims.

According to the present invention, a display apparatus is proposed for an elevator system which has at least one elevator shaft, in which a plurality of elevator cabins move. The display apparatus has at least one designation manager which assigns a temporary designation to an elevator cabin which is carrying out a transport job, and has at least one display, which is associated with an entry location in order to output, preferably to visually output, the assigned designation, with the display outputting the designations of a plurality of elevator cabins at the same time.

In this case, the elevator cabins preferably move autonomously, that is to say essentially independently of one another, although, of course, it is essential to prevent a collision between elevator cabins. In the same way, individual elevator cabins, or all of them, can also move in a coupled form.

The elevator cabins can move either just vertically or vertically and horizontally. A horizontal movement allows an elevator cabin to be transferred to another elevator shaft or to an intermediate position, which advantageously allows the formation of pure upward and downward shafts. In this case, the split into upward and downward shafts is not defined absolutely, and, for example, it is possible to use one or more elevator shafts as upward shafts at the start of a working day, with these being used as downward shafts at the end of the working day.

The designation manager associated with each entry location may be in the form of part of a central elevator control system, which assigns a specific elevator cabin to a transport job on the basis of specific criteria, for example, the load levels, the positions or the destinations of the cabins, and at the same time assigns its designation to this cabin. The assignment of the designations can advantageously be combined at one point and can be managed jointly, thus reducing the communication with autonomous systems. The expression central elevator control system in this case does not necessarily mean a physically central control system—a central elevator control system may just as well, for example, be formed by elevator cabin control systems which communicate with one another, for the purposes of the present invention.

Alternatively, the designation manager may also be in the form of an autonomous system for each entry location, which signals the designations to the central elevator control system which has registered the destination call of the user and has selected an elevator cabin to carry out the transport job, with this designation being allocated to this elevator cabin for this entry location, by the autonomous system. This advantageously reduces the load on the central elevator control system. In this case, however, care should be taken to ensure that the designation managers never allocate the same designation for different entry locations on one floor. For example, an autonomous system such as this can be integrated in a destination call station in which a user can place his destination call.

Mixed forms are also possible. For example, one designation manager can be provided for each floor and can assign designations to the elevator cabins for this floor, signaling these designations to the central elevator control system. This provides the advantages of the solutions described above.

In particular, an entry location may be formed by an elevator shaft door on one floor. If one floor can be stopped at by elevator cabins in a plurality of elevator shafts which, for example, are arranged alongside one another and/or one above the other, then their elevator shaft doors correspondingly form a plurality of entry locations on this floor. If two or more elevator shaft doors can access an elevator cabin on a floor, then each elevator shaft door can equally in its own right, or else a plurality of them, in particular all the elevator shaft doors, which the lift cabin can stop at on this floor can jointly define an entry location.

If each elevator shaft door forms a dedicated entry location, different users can be assigned the same elevator cabin through the different elevator shaft doors by this elevator cabin being assigned a dedicated designation for each entry location, that is to say for each elevator shaft door, with one of these designations being signaled to each of the various users. For example, an elevator cabin which is accessible through two elevator shaft doors "A" and "B" on the same floor can be assigned the designation "A1", by the designation manager associated with the elevator shaft door "A", while the designation manager associated with the elevator shaft door "B" can assign the designation "B1". If half of the users who are waiting on this floor and are intended to be carried by this elevator cabin are signaled the designation "A1", and the other half are signaled the designation "B1", then the users are split between the two elevator shaft doors, therefore considerably shortening the entry time.

Alternatively, the elevator shaft doors which lead to one elevator cabin on one floor can also form a joint entry location, with it being left up to the users which of the elevator shaft doors they use. This means that fewer different designations need be managed and output.

In the present case, a floor is not necessarily intended to denote vertically separated levels. For example, the elevator shaft doors to a plurality of elevator shafts may be vertically separated from one another for structural reasons, for example in a hotel lobby. These elevator shaft doors may at the same time be associated with the same floor, in this case the hotel lobby. The process of splitting into floors in fact depends on whether different entry locations, in particular elevator shaft doors, appear to be equally accessible for a user, that is to say for example are identifiable and can be seen at a glance.

Since a transport job includes not only the destination but also the start position, for example the floor where the user is waiting, the same elevator cabin can be assigned different designations on different floors in order to assign the same elevator cabin to different users at different entry locations. For example, a designation "2" may be assigned to an elevator cabin on a floor on which its elevator shaft is the only one from which an elevator cabin can be entered, and may be assigned a designation "B2" on a different floor, where the elevator cabin can be entered from each of a plurality of elevator shafts, in order to specify the elevator shaft on this floor as well. The designation "B2" can equally be assigned to an option to enter an elevator cabin, while a different option for entry to this elevator cabin can be assigned by the designation "B4".

An autonomous designation manager is preferably provided for each entry location, forming an autonomous system as described above, or else it can be implemented in a system for a plurality of entry options, for example on one floor, or a central elevator control system.

Each designation manager comprises a memory in which a number of designations are stored, which the designation manager allocates to elevator cabins which are selected by the elevator control system to stop at the entry location associated with that designation manager. The memories, which are preferably formed from electronic components, are designed such that only currently unassigned designations can be taken by the designation manager for allocation to elevator cabins. The number of designations stored in each memory is less than the number of elevator cabins which can be selected to carry out a transport job from an entry location associated with this memory. For users of elevator installations with a large number of elevator cabins, this has the advantage that they are not forced to in each case note a designation selected from a multiplicity of different designations but, for example, just one of a choice of three possible designations.

This provides a very simple and reliable display apparatus, ensuring that a designation never designates two elevator cabins at the same time at one entry location, without the need for complex management of the designations for this purpose, in particular marking them as being free or reserved.

By way of example, a memory such as this may be in the form of a first-in-first-out memory (FIFO memory). Stored designations are taken from the memory successively, are assigned to the elevator cabins that are intended to stop at the associated entry location, and are supplied to the memory again at the latest when the corresponding elevator cabin leaves the entry location again.

A dedicated memory is therefore also provided in a designation manager for a plurality of entry locations, for example on one floor, or a central elevator control system, and therefore preferably for each entry location, although this dedicated memory need not be physically autonomous but also, for example, can be represented by appropriate partitioning in the area of a larger physical memory.

A memory may also be in the form of software. To this extent, any memory management which outputs successive elements (designations) is referred to in an abstract form as a memory, but provided care is taken to ensure that each of the elements is output only when it is currently not already being used as a designation, that is to say when a specific element has been fed back to the memory again after being used, and has been registered as no longer being used.

A display apparatus according to the present invention comprises a display for outputting one or more designations which is or are associated with an entry location. The association is preferably physical, for example by the display being arranged alongside, above or in the vicinity of an elevator shaft door. However, the association may equally also be in a more abstract form, for example by designations for different elevator shaft doors on one floor being output on a central display. For this purpose, for example, the designations of the corresponding elevator cabins can be output alongside the individual elevator shaft doors on a layout plan. For the purposes of the present invention, a designation can in this case equally be output or displayed visually, in particular in the form of alphanumeric characters, symbols and/or colors, audibly, in particular in the form of spoken words, melodies or tones, in a tactile form, in particular in the form of Braille characters, or in some other perceptible manner.

A designation is preferably passed to the memory as soon as the elevator cabin to which it has been assigned leaves the entry location, and is therefore available again. This makes it possible for a further user arriving later to have indicated to him that the elevator cabin which is still at the entry location is still an elevator cabin which can also carry out his transport job provided, for example, that the transport jobs are identical or can be agreed with one another well. Alternatively, the designation can also be sent back to the memory as soon as the elevator cabin to which it has been assigned arrives at the entry location. This designation is therefore available for reallocation at an early stage, thus reducing the number of designations required and therefore the capacity of the memory. According to a further alternative, the designation can, for example, be supplied to the memory again and the appropriate display can be canceled as soon as the elevator shaft door starts to close. This avoids users who arrive late entering too late and therefore in a dangerous manner. In any case, it is advantageous to no longer output the designation on the associated display as soon as it has been sent back to the memory.

Particularly when a plurality of elevator shafts on at least one floor offer an entry capability, the designation may have a shaft-specific component. It is thus possible to clearly instruct the user to use a specific elevator cabin in a specific elevator shaft. The entire designation including its shaft-specific component is then preferably indicated on the display, for example "U2", where "U" denotes the elevator shaft and "2" denotes a specific cabin moving in it. This advantageously makes it possible to allocate the designations to the elevator shafts dynamically and to denote the same elevator shaft, for example, firstly with "U" (for "Up") and on another occasion with "D" (for "Down"), thus increasing the flexibility. This therefore also allows a standard designation to be made available, whose appearance on the display corresponds to that which has been signaled to the user. This is particularly advantageous for those who are illiterate or for foreign users who do not understand the characters used for the designation and just compare them photographically. Alternatively, it is also possible to display the shaft-specific component above the respective elevator shaft door, for example, rather than on the display. This reduces the display and therefore the control, maintenance and production effort, but requires the user to have a better transfer performance since, for example, he must now associate a designation "U2" with the elevator cabin which is denoted by "2" on the display of the elevator shaft identified by "U".

The designations may have a cabin-specific component which is used to distinguish between the individual elevator cabins within one elevator shaft. The cabin-specific components are preferably taken in an organized sequence from a letter and/or character set, for example the natural numbers 1, 2, 3, . . . displayed in Arabic or Roman form. This allows a particularly impressive presentation of the designations and also simplifies their management.

The invention proposes that a display apparatus for an elevator system having at least one elevator shaft in which a plurality of elevator cabins move and which has a designation manager in order to assign a designation temporarily to an elevator cabin carrying out a transport job, at the same time has a display associated with an entry location for outputting a plurality of elevator cabins at the same time, advantageously in the sequence in which they arrive at the entry location. For example, this sequence can be displayed by a spatial arrangement alongside one another or one above the other. The user is therefore provided with an overview of the elevator system and can therefore, for example, better estimate his waiting time. In addition, he can be signaled at an early stage that his transport job has been assigned to an elevator cabin and, so to speak, he can follow the path taken by "his" elevator cabin. It is preferably to display at least the designations of the next two or three elevator cabins which will stop at that entry location.

If, for example, the memory contains the natural numbers 1, 2, 3, . . . in a chronological sequence, possibly preceded by a shaft-specific component for example in the form of a Latin capital letter "A", "B", "C", . . . then the first elevator cabin which will stop at this entry location is assigned the designation "1" (or "A1", "B1", . . . ), the next elevator cabin is assigned the designation "2" (or "A2", "B2", . . . ), and so on. As soon as an elevator cabin has left the entry location, its designation is passed back to the memory so that it is reallocated as soon as all of the designations fed back to the memory before it have been allocated. If the memory is in the form of a FIFO memory, then the sequence "1", "2", "3" (and "A1", "A2, "A3" etc.), is then repeated cyclically, but with each elevator cabin being displayed on the display at a specific entry location by means of the same designation until it has reached this entry location, or left it again. This therefore advantageously maintains a designation sequence which can be predetermined by the initial occupancy of the FIFO memory.

The respective displays associated with one of the floors preferably indicate the position of one or more elevator cabins to which a designation to stop on the associated floor has been assigned. This can be done, for example, by the designations associated with the arriving elevator cabins being displayed alongside a row of display elements which map the floor positions. This improves the overview of the elevator system for the elevator users since they now know not only the sequence in which the elevator cabins will arrive but also the route that they still have to travel. A user can therefore better estimate the waiting time before "his" elevator cabin will arrive.

If the elevator cabins in a first elevator shaft are moving upwards and those in a second elevator shaft are moving downwards, then an elevator cabin can actually be displayed by a display associated with the first elevator shaft while that elevator cabin is actually still in the other elevator shaft. In this case, the position of an elevator cabin such as this can be displayed realistically, that is to say it can be displayed at positions which vary in the opposite direction to the direction of travel of the elevator cabins in one elevator shaft, or in a simplified form, for example by static display elements which are arranged in front of a first or after a last floor position display of the first elevator shaft.

In a display apparatus according to the present invention, the memory capacity of the memory may be less than the maximum number of elevator cabins moving in an elevator shaft. In general, the elevator cabins passing a specific entry location do not all stop at this entry location as well. Those cabins which do not stop need not be assigned a designation for these entry locations, thus making it possible to reduce the memory capacity of the memory.

In a method for communication with an elevator system according to the present invention, a user is signaled the designation of an elevator cabin which will carry out his transport job in reaction to his destination call, and this is displayed on a display associated with an entry location before this elevator cabin arrives there, and for as long as it remains there. The user can place the destination call, for example, by inputting a desired destination floor, a specific area (for example his room number), a specific destination (for example "hotel swimming bath") or a person being visited (associated with his office) or the like by means of an alphanumeric keypad, voice recognition, touch-pad or the like to a destination call station, a card reader, a mobile telephone or the like or by carrying or activating a transmitter such as a hotel room key or an ID card. The elevator control system assigns the transport job (which, in addition to the destination, may also include the starting point, for example the floor where the destination call has been made, a user priority and the like) to a specific elevator cabin using specific criteria.

A designation manager assigns an individual designation to this elevator cabin for the entry location, and this is signaled to the user: for this purpose, the assigned designator may, for example, be output in a visual and/or audible form for example at the destination call point or on the card reader, or may be displayed on the user's mobile telephone.

The designation is displayed at the entry location when the elevator cabin arrives there. The user therefore knows that this elevator cabin will carry out his transport job, and enters it.

According to one embodiment of the present invention, the designation associated with an entry location is assigned cyclically to the elevator cabins, preferably in the sequence in which they arrive and stop there. If the total number of designations is n, for example the natural numbers 1, 2, . . . n, then the first elevator cabin which will stop at that entry location is assigned the designation 1, the second elevator cabin is assigned the designation 2, and the n-th elevator cabin is assigned the designation n. The (n+1)-th elevator cabin is once again assigned the designation 1, the (n+2)-th elevator cabin the designation 2, and so on.

According to the invention, a plurality of designations associated with one entry location are displayed at the same time. In this case, the number of possible designations is advantageously chosen to be greater than or equal to the number of designations which are output as a maximum on the display associated with that entry location. If the number of possible designations corresponds precisely to the maximum number of those displayed, then the memory space can be minimized. If the number of possible designations is greater than the maximum number of designations which can be displayed, the designation of an elevator cabin which has just left the entry location does not appear immediately after this as the designation for the elevator cabin which is newly arriving on the display, thus improving the clarity of the display.

It is, of course, also possible for a plurality of users on one floor and whose destination floors are identical or differ from one another but can be agreed with one another to be assigned the same elevator cabin. If a designation manager therefore assigns a temporary designation for a specific entry location as a consequence of a destination call by a first user for an elevator cabin, and outputs this to the first user, and the elevator control system assigns the same elevator cabin to a second user on the same floor on the basis of his destination call, then this designation which has already been output is also output to this second user so he would use the same elevator cabin.

If, for example, a first user on the first floor calls an elevator in order to travel to the third floor, then the elevator control system assigns this first user an elevator cabin which is temporarily allocated the designation "U2" by the designation manager for the first floor, and this designation is passed to the first user. If a second user on the first floor now calls an elevator in order to travel to the second floor, the elevator control system will assign him the same elevator cabin as that which the designation manager for the first floor has temporarily assigned the designation "U2". In a corresponding manner, this designation is also passed to the second user. If a third user on the first floor calls an elevator in order likewise to travel to the third floor, the elevator control system will assign him the same elevator cabin which the designation manager for the first floor has assigned the designation "U2". This designation is also passed in a corresponding manner to the third user.

When this elevator cabin approaches the first floor or has stopped there, the display outputs this designation "U2". This display allows not only the first but also the second and the third user to see that this elevator cabin is carrying out their transport job, and they enter it. The elevator cabin then moves successively to the second and third floors.

Further objects, advantages and features will become evident from the following detailed description, exemplary embodiments, and the accompanying drawings.

DETAILED DESCRIPTION

Figures 1, 2A, 2B, 2C:
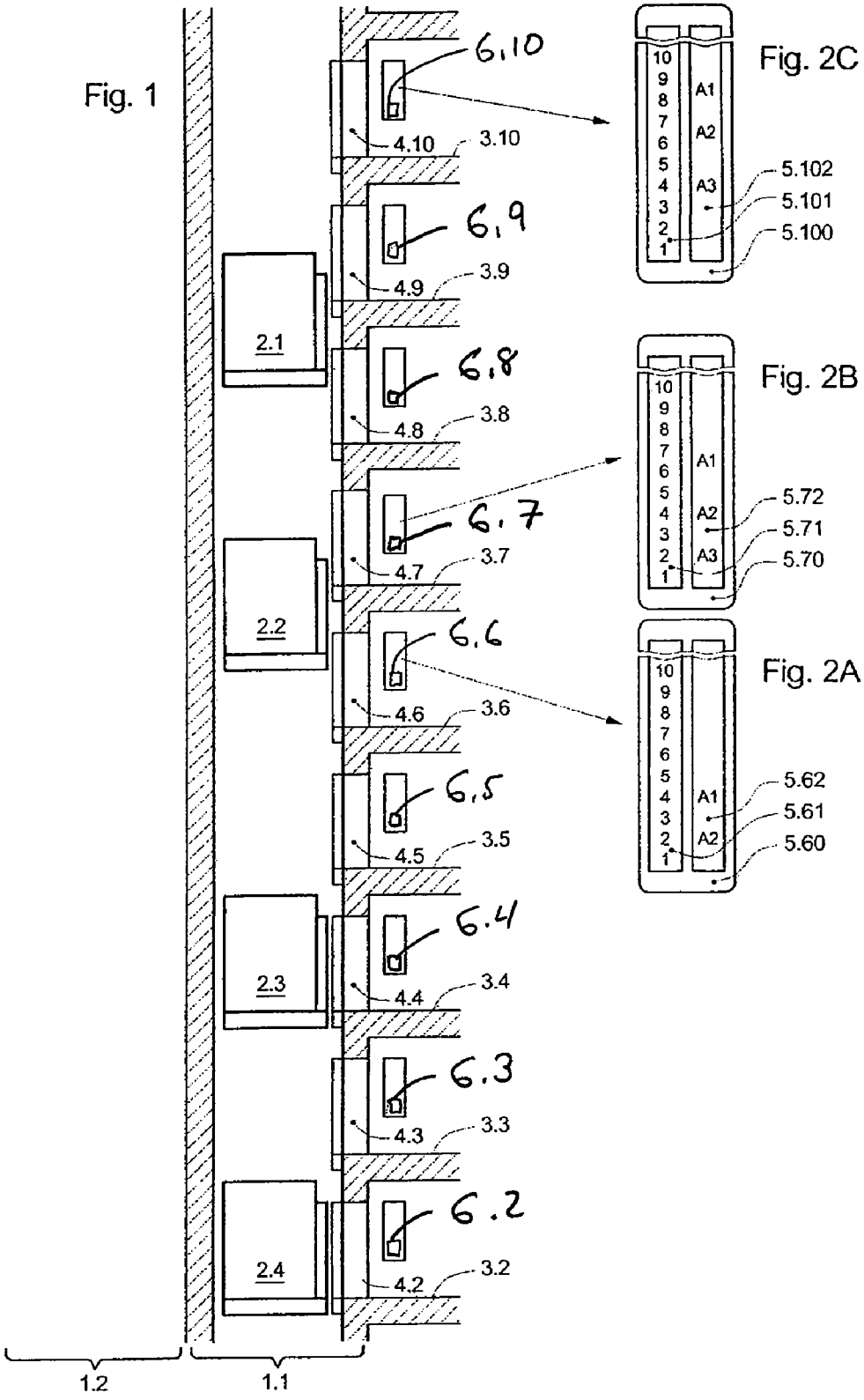
FIG. 1 shows a partial section through an elevator system having a display apparatus according to one embodiment of the present invention, in a first state.
FIGS. 2A-2C each show a display of the elevator system shown in FIG. 1, associated with an entry location.

FIG. 1 shows, partially schematically, an elevator shaft 1.1 of an elevator system in which elevator cabins 2.1 to 2.4 can move upwards autonomously between floors 3, of which only the second to the tenth floor 3.2 to 3.10 are illustrated. As shown in FIG. 1, a further elevator shaft 1.2, which is preferably used for the elevator cabins to move downwards, as well as further elevator shafts that are not illustrated, can be arranged alongside the elevator shaft 1.1. In this case, the elevator shafts 1 are not necessarily physically separate from one another but, for example, may be defined by guide rails for the elevator cabins 2. The invention will be explained in the following text on the basis of an elevator shaft 1.1 in which the elevator cabins 2 move only upwards. The statements apply in a corresponding manner to the elevator shaft 1.2 as well, in which the elevator cabins move only downwards, and to elevator shafts (not illustrated) in which the elevator cabins can autonomously move both upwards and downwards. The movement direction in the elevator shaft 1.1 and/or 1.2 may also be reversed in order, for example, to provide a greater transport capacity in the upward direction or downward direction, for example, at the start or end of a working day.

The elevator shaft 1.1 has an elevator shaft door 4 on each floor, forming an entry location. A display 5 of the display apparatus according to one embodiment of the present invention is arranged over each elevator shaft door 4 such that a user clearly associates this display with the elevator shaft door located underneath it. FIGS. 2A to 2C show, by way of example, the displays 5.60, 5.70 and 5.100, respectively, associated with the respective elevator shaft doors 4.6, 4.7 and 4.10 on the sixth, seventh and tenth floors 3.6, 3.7 and 3.10, respectively. The displays which are not shown for the other elevator shaft doors 4 for the elevator shaft 1.1 and the elevator shaft doors for the further elevator shafts are physically identical.

Each display 5 comprises a floor strip 5.i1 and a position strip 5.i2, where i=1, 2, . . . , denoting the floor.

In a first state, as illustrated in FIG. 1, cabin 2.4 has stopped at the second floor and the cabin 2.3 has stopped at the fourth floor, while the cabins 2.2, 2.1 are currently moving from the sixth to the seventh floor and from the eighth to ninth floor, respectively. Two user groups have made destination calls at the floor 3.6, and three user groups have made destination calls on both the floors 3.7 and 3.10. In this case, a user group is defined as one or more people whose initial floor is identical and to whom the same elevator cabin is assigned.

For this purpose, users enter their destination via a keypad in the area of the entry locations, for example on the floor on which they wish to enter, or send the destination via a mobile telephone to a receiver. Alternatively or additionally, the users can also enter their destination using a destination dialing device associated with that floor, which device is not arranged directly in the area of the entry locations. A central elevator control system (not illustrated) assigns the transport jobs resulting from the destination calls in accordance with predetermined criteria (for example the shortest waiting time for all users) to specific elevator cabins 2. The following table shows one example of such assignments:

| | User group | | | | | | | |
|---|---|---|---|---|---|---|---|---|
| | 1 | 2 | 3 | 4 | 5 | 6 | 7 | 8 |
| Floor | 3.6 | 3.6 | 3.7 | 3.7 | 3.7 | 3.10 | 3.10 | 3.10 |
| Assigned elevator cabin | 2.3 | 2.4 | 2.2 | 2.3 | 2.4 | 2.1 | 2.2 | 2.3 |

Once the central elevator control system has assigned an elevator cabin 2 to a user group, a designation manager 6 which is associated with an entry location 4 with a display apparatus 5 according to the invention assigns an elevator cabin 2 a temporary designation which it can take from a memory, for example a FIFO memory.

In the first state, as illustrated in FIG. 1 and in the table, by way of example, the user group "1" on the sixth floor 3.6 has first of all been assigned the elevator cabin 2.3, after which the user group "2" has been assigned the elevator cabin 2.4. In a corresponding manner, designation manager 6.6 for the floor 3.6 with the elevator shaft door 4.6 first of all takes the designation "A1" from its memory, and temporarily assigns this to the elevator cabin 2.3. It then takes the next designation "A2" from its memory, and temporarily assigns this to the elevator cabin 2.4.

In a corresponding manner, designation manager 6.7 which is associated with the floor 3.7 with the elevator shaft door 4.7 first of all takes the designation "A1" from its memory and temporarily assigns this to the elevator cabin 2.2, which was firstly assigned a transport job for the seventh floor, and it then takes from its memory the next designation "A2" and temporarily assigns this to the elevator cabin 2.3, before finally taking the next designation "A3" from its memory and temporarily assigning this to the elevator cabin 2.4 to which a transport job for the seventh floor was last assigned.

Designation manager 6.10 which is associated with the elevator shaft door 4.10 operates in an analogous manner, so that this results in the following assignment of entry-location-specific temporary designations to the elevator cabins:

| Elevator | Floor | | |
|---|---|---|---|
| cabin | 3.6 | 3.7 | 3.10 |
| 2.1 | | | A1 |
| 2.2 | | A1 | A2 |
| 2.3 | A1 | A2 | A3 |
| 2.4 | A2 | A3 | |

As can clearly be seen, a different designation is in each case assigned to the same elevator cabin (for example the cabin 2.3) by designation managers 6.6 6.7, 6.10 which are associated with the respective entry locations 4.6, 4.7 and 4.10 on the respective floors 3.6, 3.7 and 3.10. This does not pose any problems because the elevator cabin need be uniquely identifiable only on the respective floor 3. As can likewise be seen from the table, elevator cabins to which no transport job has been assigned for the relevant floor and which therefore also need not be identified on this floor, are not assigned any designation.

If an elevator cabin such as this which has not been assigned a designation stops in order to allow a user to leave, then the missing display of a designation signals the fact that this elevator cabin is not intended for any transport job originating from this floor. As a precaution against the user being confused or misinterpreting the lack of display as a display failure, however, a designation manager can also assign a designation to elevator cabins such as these whose transport job ends at the entry location associated with that designation manager.

As can likewise be seen from the table above, a maximum of three elevator cabins are assigned designations at the same time in each elevator shaft by one designation manager. The memories accordingly have three memory locations which are filled in advance with the designations "A1", "A2" and "A3" in this sequence.

The designations assigned to the individual elevator cabins are output on the display 5 associated with the entry location 4 corresponding to the position of the elevator cabin to which they are assigned. In this case, the respective designations "A1", "A2" and "A3" on the position strip 5.12 illuminate at the appropriate point under the floor strip 5.11, as shown in FIGS. 2A to 2C. A designation on the position strip 5.12 is advantageously permanently illuminated for as long as the associated elevator cabin is approaching the respective entry location, and then starts to blink as soon as the elevator cabin starts the braking process. This signals particularly clearly that the elevator cabin is just arriving, particularly if a user does not know the floor on which he is located and the simple position display that an elevator cabin is located on his floor would have little meaning for him.

Figures 3, 4A, 4B, 4C:
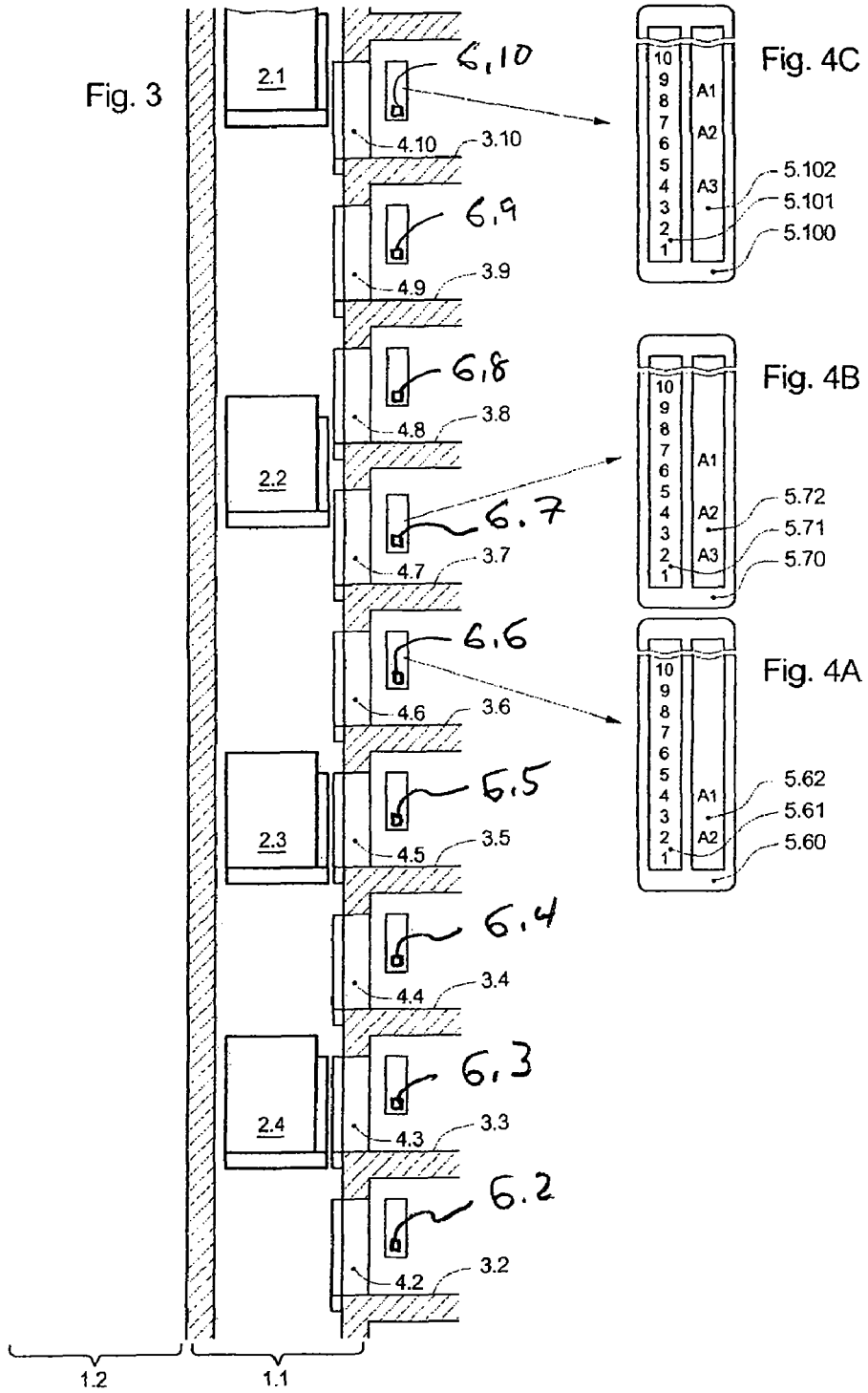
FIG. 3 shows a partial section through the elevator system shown in FIG. 1, in a second state.
FIGS. 4A-4C show an illustration corresponding to FIGS. 2A to 2C, in a second state.

FIG. 3 shows a second state which follows the first state, as described above, in time. FIGS. 4A to C show, in a corresponding manner to FIGS. 2A to C, the displays which are associated with the respective elevator shaft doors 4.6 (FIG. 4A), 4.7 (FIG. 4B) and 4.10 (FIG. 4C), respectively.

In the second state, the cabin 2.1 is currently at the tenth floor 3.10, and is leaving it. The associated designation manager 6.10 has accordingly passed the designation "A1", which had been assigned to the cabin 2.1, back to its memory, and deleted it from the display 5.100. If a destination call on the tenth floor is now, for example, assigned to the elevator cabin 2.4, then designation manager 6.10 for the entry location 4.10 takes the next designation from its memory. Since the memory has only three memory locations, the designation "A1" which is currently being supplied is taken as the next one, and is now allocated to the elevator cabin 2.4 (see FIG. 4C).

In a corresponding manner, the designation manager 6.7 associated with the entry location 4.7 cancels the designation "A1" on the display 5.7 as soon as the cabin 2.2 leaves the seventh floor, and passes it back to its memory.

As can be seen particularly clearly from this, the temporary designations which are assigned to elevator cabins which are each intended for one entry location are assigned until the designated elevator cabins have left that entry location. The elevator cabin 2.3 is, for example, still denoted by "A2" in the second state on the seventh floor, even though there is no "A1".

In consequence, the designations "A1", "A2" and "A3", are assigned to the elevator cabins cyclically, as can be seen in particular from the display 5.100 in FIGS. 2C and 4C:

| | Elevator cabin with transport job | | | | | | |
|---|---|---|---|---|---|---|---|
| | 2.1 | 2.2 | 2.3 | 2.4 | . . . | . . . | . . . |
| Designation | A1 | A2 | A3 | A1 | A2 | A3 | . . . |

In a corresponding manner, the designation manager may be designed in a very simple and reliable form, with their memories requiring only a small capacity. The individual designation managers and their memories may in this case equally be implemented in the form of autonomous systems associated with the respective entry locations 4, by means of a system for an entire floor 3 or in a central elevator control system. In a corresponding manner, according to the present invention, a central display apparatus may, for example, be implemented in the central elevator control system and may comprise the individual displays 5 associated with the respective entry locations 4. Alternatively, the central elevator control system can communicate with autonomous display apparatuses which are each associated with one entry location 4.

A method for communication with the elevator system described above is now carried out, according to one embodiment of the present invention, as follows:

First of all, a user places a designation call. To do this, for example, he enters his destination via a keypad which is arranged centrally for all the entry locations on one floor. For example, in the first state as shown in FIG. 1, a user on the seventh floor 3.7 has entered the eleventh floor as his destination.

The central elevator control system registers this designation call and assigns an appropriate transport job to an elevator cabin 2. In the first state as shown in FIG. 1, the transport job has been assigned, for example, to the elevator cabin 2.3 since the elevator cabin 2.2 which had previously stopped at the seventh floor is intended to move quickly to the fifteenth floor, without stopping at the eleventh floor.

As soon as the elevator cabin 2.3 has been assigned the transport job starting from the seventh floor, the designation manager 6.7 for the entry location 4.7 temporarily assigns the next designation from its memory to this cabin. Since the designation "A1" has already been used and allocated to the cabin 2.2, the next designation "A2" is now taken, and is temporarily assigned to the elevator cabin 2.3.

This designation "A2" is signaled to the user as a response to his destination call on a display alongside the keypad for the destination call input.

As soon as the elevator cabin 2.3 is one of the next three elevator cabins, which are approaching and will stop at the entry location 4.7, its designation "A2" is displayed on the display 5.70 associated with the entry location 4.7, on the position strip 5.72 at an appropriate point under the floor strip 5.71 (FIG. 2B). The user will see the designation on the display, providing the information with him, and will move to the elevator shaft door 4.7.

First of all, the cabin 2.2 stops on the seventh floor (state between the first and the second state). The user sees from the blinking display "A1" on the floor position "7" on the display 5.70 that this cabin 2.2 is not carrying out his transport job (since this cabin is intended to move to the fifteenth floor without stopping at the eleventh floor).

As soon as the cabin 2.2 has left the seventh floor (second state, FIG. 3), the designation "A1" disappears from the display 5.70. From the position of the designation "A2" on the position strip 5.72 relative to the floor strip 5.71, the user can track how "his" elevator cabin 2.3, which has been assigned the designation "A2" is approaching the entry location 4.7. As soon as it has reached this entry location 4.7, the display "A2" under the floor indication "7" blinks, and the user enters the elevator cabin 2.3 which has been assigned his transport job.

If users also enter transport jobs in the downward direction and/or elevator cabins are moving upwards in other elevator shafts (not illustrated), transport jobs can also be assigned to elevator cabins in other elevator shafts. For example, an appropriate transport job is assigned to an elevator cabin in the elevator shaft 1.2 in a manner that is not illustrated in any more detail, in response to a destination call on the seventh floor with a destination on the sixth floor, and a designation, for example "B2", is assigned to this elevator cabin by a designation manager associated with the elevator shaft door leading to the elevator shaft 1.2 on the seventh floor, with this being signaled to the user and being output on a display associated with this elevator shaft door, when the corresponding elevator cabin stops on the seventh floor. The user analogously recognizes "his" elevator cabin and can distinguish it on the basis of the shaft-specific component "B" in the designation "B2" from the elevator cabin 2.3 with the designation "A2".

For this purpose, it is necessary for the designations which are assigned to the elevator cabins to each be assigned only once, unambiguously, at any given time on each floor. For the elevator cabins which are moving within an elevator shaft and therefore use the same entry location, for example an elevator shaft door, this is ensured by the assignment of the designation just described above from the memory of the designation manager associated with that entry location. For elevator cabins in different elevator shafts, this can advantageously be achieved by a shaft-specific component in the designation, for example the abovementioned Latin capital letters "A" and "B".

However, the present invention is not restricted to this. For example, a shaft-specific component and/or a cabin-specific component of a designation can also be defined by any alphanumeric characters, symbols and/or colors.

In the exemplary embodiment, the individual user groups whose transport jobs differ have each been assigned their own elevator cabins. However, of course, this need not be the case. For example, it would be just as possible to assign the same elevator cabin 2.1 to the user groups 6 and 7 on the floor 3.10, as well.

In this case, the designation manager temporarily assigns the designation "A1" to the elevator cabin 2.1 for the tenth floor once the destination call from the user group 6 has been received, and signals this to the user who has placed the destination call. Once the destination call is received from the user group 7 and this transport job has been assigned by the elevator control system, in a modified form of the exemplary embodiment, to the same elevator cabin 2.1, the designation manager sees that the elevator cabin 2.1 has already been assigned a temporary designation for the tenth floor. Accordingly, it does not assign a new designation to this cabin but also signals the designation "A1" to the user from the second user group who has placed this destination call. Further users from the first or second user groups are also in the same way assigned the same elevator cabin 2.1 on the basis of the fact that their transport jobs are identical or compatible, with the already allocated designation "A1" accordingly being signaled.

On the basis of the display 5.100, the users in the first and second user groups see that they are intended to enter the cabin 2.1 when it stops on the tenth floor. The elevator cabin 2.2 in this modified form is accordingly temporarily assigned the next designation "A2" in response to the first destination call from the third user group 8.

The invention claimed is:

1. A display apparatus for an elevator system having at least one elevator shaft in which a plurality of elevator cabins move, comprising:

a designation manager to assign a temporary designation to an elevator cabin carrying out a transport job; and at least one display associated with an entry location to output the assigned temporary designation, wherein the display is further to output designations of a plurality of elevator cabins moving in the at least one elevator shaft at the same time and to indicate an arrival sequence of the elevator cabins at the display, the arrival sequence associated with the assigned designation.

2. The display apparatus of claim 1, wherein, the plurality of elevator cabin designations output by the display are assigned to elevator cabins that will be next to stop at the entry location associated with the display.

3. The display apparatus of claim 1, wherein the display is further to show a position of each of the plurality of elevator cabins to which a designation has been assigned.

4. The display apparatus of claim 1, further comprising:

a plurality of displays, each display being associated with a respective entry location having an associated designation manager to assign an entry-location-specific designation to each elevator cabin, wherein the entry-location-specific designation is chosen by an elevator control system to carry out a transport job originating from the associated entry location.

5. The display apparatus of claim 1, wherein the plurality of designations each comprise a shaft-specific component.

6. The display apparatus of claim 1, wherein the designations each comprise an elevator cabin-specific component.

7. The display apparatus of claim 6, wherein the designation managers comprise a memory in which the cabin-specific components of the designations are stored, the number of designations stored in each memory being less than a number of elevator cabins used in the elevator system, and being such that only designations which have not been assigned at any given time can be taken by the designation manager for assignment.

8. The display apparatus of claim 7, wherein the memory is a FIFO memory from which the designations to be assigned are read successively and to which assigned designations are fed back again successively at the latest when the elevator cabins to which they have been assigned leave the entry location.

9. A method for communication with an elevator system which comprises at least one elevator shaft in which a plurality of elevator cabins move, with a display apparatus, the method comprising:

assigning by a designation manager a temporary designation to an elevator cabin carrying out a transport job;

outputting the temporary designation at a display associated with an entry location; and outputting designations of a plurality of elevator cabins moving in the elevator shaft, wherein the designations are output by the display so as to indicate a sequence of arrival of the plurality of elevator cabins.

10. The method of claim 9, wherein the output designations are assigned to those elevator cabins which will in each case be the next to stop at the entry location with which the display is associated.

11. The method of claim 9, wherein the designations are output by the display so as to indicate a respective position of each of the plurality of elevator cabins.

12. The method of claim 9, further comprising:

receiving a transport job at a destination selection station associated with a floors serviced by the elevator system, the floor having at least one associated entry location;

selecting a particular elevator cabin for the received transport job;

assigning by the designation manager associated with the at least one entry location an entry-location-specific designation to the particular elevator cabin; and displaying, at the display associated with the at least one entry location, designations of a plurality of elevator cabins next to stop at the particular entry location.

13. The method of claim 9, wherein the designation of the plurality of elevator cabins comprise a shaft-specific component and a cabin-specific component, the cabin-specific component having a range of values smaller than a number of elevator cabins that can be selected for carrying out a transport job from the entry location.

14. The method of claim 13, wherein the cabin-specific components are chosen by the designation manager from a memory storing currently unassigned designations.

* * * * *